US011373593B2

(12) United States Patent
Bang et al.

(10) Patent No.: US 11,373,593 B2
(45) Date of Patent: Jun. 28, 2022

(54) DISPLAY DEVICE AND METHOD FOR GENERATING COMPENSATING DATA OF THE SAME

(71) Applicant: Samsung Display Co., Ltd., Yongin-si (KR)

(72) Inventors: Sunghoon Bang, Seoul (KR); Min-Seok Bae, Hwaseong-si (KR); Wooseok Han, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 293 days.

(21) Appl. No.: 16/182,995

(22) Filed: Nov. 7, 2018

(65) Prior Publication Data

US 2019/0139490 A1 May 9, 2019

(30) Foreign Application Priority Data

Nov. 8, 2017 (KR) ..... 10-2017-0148279

(51) Int. Cl.
*G09G 3/3233* (2016.01)
*G09G 3/20* (2006.01)
*G09G 3/3275* (2016.01)

(52) U.S. Cl.
CPC ..... *G09G 3/3233* (2013.01); *G09G 3/2007* (2013.01); *G09G 3/3275* (2013.01); *G09G 2300/0413* (2013.01); *G09G 2310/0248* (2013.01); *G09G 2320/0223* (2013.01)

(58) Field of Classification Search
CPC .. G09G 3/3233; G09G 3/2007; G09G 3/3275; G09G 2300/0413; G09G 2310/0248; G09G 2320/0223
See application file for complete search history.

(56) References Cited

U.S. PATENT DOCUMENTS

2007/0146273 A1* 6/2007 You ..... G09G 3/3648 345/89
2009/0009508 A1* 1/2009 Koo ..... H04N 13/359 345/214
2009/0237338 A1* 9/2009 Sumi ..... G09G 3/3611 345/89

(Continued)

FOREIGN PATENT DOCUMENTS

KR 10-2016-0030652 A 3/2016
KR 10-2017-0072994 A 6/2017

*Primary Examiner* — Patrick N Edouard
*Assistant Examiner* — Eboni N Giles
(74) *Attorney, Agent, or Firm* — Lewis Roca Rothgerber Christie LLP

(57) ABSTRACT

A display device includes a display panel including a plurality of data lines, a plurality of gate lines, and a plurality of pixels and a compensating data generator configured to sense a sensing driving current of the pixel in an Nth frame and a target driving current of the pixel in an (N+M)th frame, and to calculate an over driving data that allows the sensing driving current to be the same with the target driving current by changing a data voltage of the Nth frame when a sensing image having a first grayscale in a (N−1)th frame and having a second grayscale in the Nth frame and the (N+M)th frame, where N is an integer greater than or equal to 2, and M is an integer greater than or equal to 1.

16 Claims, 11 Drawing Sheets

(56) References Cited

U.S. PATENT DOCUMENTS

| | | | | |
|---|---|---|---|---|
| 2010/0156819 | A1* | 6/2010 | Takahashi | G06F 3/0412 345/173 |
| 2013/0088502 | A1* | 4/2013 | Shih | G09G 5/363 345/545 |
| 2016/0104428 | A1* | 4/2016 | In | G09G 3/3291 345/214 |
| 2017/0162127 | A1 | 6/2017 | Park et al. | |
| 2018/0336846 | A1* | 11/2018 | Lee | G09G 3/36 |
| 2019/0122636 | A1* | 4/2019 | Tang | G09G 3/3225 |

* cited by examiner

FIG. 3A

CHART1

| Grn(RD80S) | | Gn-1 | | | | | | |
|---|---|---|---|---|---|---|---|---|
| | | 0 | 10 | 20 | 32 | 64 | 128 | 191 |
| Gn | 0 | | | | | | | |
| | 64 | 66.67% | 77.78% | 87.18% | 90.60% | | | |
| | 128 | 70.00% | 75.56% | 82.22% | 85.56% | 91.11% | | |
| | 191 | 69.84% | 73.02% | 77.78% | 80.95% | 85.71% | 98.41% | |
| | 255 | 72.97% | 75.68% | 80.41% | 83.11% | 87.16% | 93.92% | 97.97% |

CHART2

| Grn(TFT SENSE) | | Gn-1 | | | | | | |
|---|---|---|---|---|---|---|---|---|
| | | 0 | 10 | 20 | 32 | 64 | 128 | 191 |
| Gn | 0 | | | | | | | |
| | 64 | 71.42% | 77.46% | 88.52% | 90.79% | | | |
| | 128 | 69.28% | 74.83% | 82.91% | 87.12% | 91.21% | | |
| | 191 | 69.61% | 73.99% | 80.64% | 83.90% | 88.63% | 95.87% | |
| | 255 | 71.76% | 75.31% | 81.28% | 84.14% | 88.46% | 99.57% | 100.19% |

FIG. 5

| | | (n-1)th frame(1ST GRAYSCALE) | | | | | | | | |
|---|---|---|---|---|---|---|---|---|---|---|
| | | 0 | 32 | 64 | 96 | 128 | 160 | 192 | 224 | 255 |
| Nth fram e(2ND GRAYSCALE) | 0 | | | | | | | | | |
| | 32 | ODD1 | | | | | | | | |
| | 64 | ODD2 | ODD9 | | | | | | | |
| | 96 | ODD3 | ODD10 | ODD16 | | | | | | |
| | 128 | ODD4 | ODD11 | ODD17 | ODD22 | | | | | |
| | 160 | ODD5 | ODD12 | ODD18 | ODD23 | ODD27 | | | | |
| | 192 | ODD6 | ODD13 | ODD19 | ODD24 | ODD28 | ODD31 | | | |
| | 224 | ODD7 | ODD14 | ODD20 | ODD25 | ODD29 | ODD32 | ODD34 | | |
| | 256 | ODD8 | ODD15 | ODD21 | ODD26 | ODD30 | ODD33 | ODD35 | ODD36 | |

DISPLAY DEVICE AND METHOD FOR GENERATING COMPENSATING DATA OF THE SAME

CROSS-REFERENCE TO RELATED APPLICATION

This application claims priority to and the benefit of Korean Patent Application No. 10-2017-0148279, filed on Nov. 8, 2017 in the Korean Intellectual Property Office (KIPO), the contents of which are incorporated herein in its entirety by reference.

BACKGROUND

1. Field

Aspects of example embodiments relate generally to a display device.

2. Description of the Related Art

Flat panel display (FPD) devices are widely used as a display device of electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. The OLED devices have been spotlighted as next-generation display devices because the OLED devices have various advantages such as a wide viewing angle, a rapid response speed, a thin thickness, low power consumption, etc. An over driving method that compensates a driving data of a first frame may be utilized to prevent the brightness of the first frame from decreasing when brightness is changed.

The above information disclosed in this Background section is only for enhancement of understanding of the background and therefore it may contain information that does not constitute prior art.

SUMMARY

Aspects of example embodiments relate generally to a display device. For example, aspects of some example embodiments of the present inventive concept relate to a display device and a method for generating compensating data of the same.

Some example embodiments include a display device capable of improving display quality.

Some example embodiments include a method for generating a compensating data of the display device capable of improving display quality.

According to some example embodiments of the present invention, a display device includes: may include a display panel including a plurality of data lines, a plurality of gate lines, and a plurality of pixels and a compensating data generator configured to sense a sensing driving current of the pixel in a Nth frame and a target driving current of the pixel in a (N+M)th frame, and to calculate an over driving data that allows the sensing driving current to be the same with the target driving current by changing a data voltage of the Nth frame when a sensing image having a first grayscale in a (N−1)th frame and having a second grayscale in the Nth frame and the (N+M)th frame, where the N is an integer greater than or equal to 2, and M is an integer greater than or equal to 1.

In example embodiments, the compensating data generator may generate the plurality of over driving data by changing a grayscale value of the first grayscale and a grayscale value of the second grayscale, and generates an over driving lookup table (LUT) based on the plurality of over driving data.

In example embodiments, a grayscale value of the first grayscale may be lower than a grayscale value of the second grayscale.

In example embodiments, the compensating data generator may include a sensing image generator configured to generate a sensing image data corresponding to the sensing image, a feedback controller configured to sense the sensing driving current and the target driving current, to provide an over driving voltage to the data line of the display panel in the Nth frame when the sensing driving current is lower than the target driving current, and to provide the providing number of the over driving voltage to a memory when the sensing driving current is higher than or equal to the target driving current, the memory configured to store the providing number of the over driving voltage provided from the feedback controller, and an over driving lookup table generator configured to calculate the over driving data based on the providing number of the over driving voltage and to generate an over driving lookup table based on the over driving data.

In example embodiments, the feedback controller may perform a feedback loop that provides the over driving voltage to the data line of the driving panel until the sensing driving current is the same with the target driving current.

In example embodiments, the over driving voltage may have a voltage level corresponding to a predetermined reference grayscale.

In example embodiments, the over driving data may be calculated by adding a multiplying value of the reference grayscale by the proving number to the second grayscale.

In example embodiments, the feedback controller may include a first converter configured to convert the sensing driving current to a first digital signal and to convert the target driving current to a second digital signal, a comparator configured to the first digital signal to the second digital signal and to output a comparing result as an output signal, and a second converter configured to convert the output signal to an analog signal and to output the analog signal as the over driving voltage.

In example embodiments, the comparator may output a low level signal when the first digital signal is higher than or equal to the second digital signal, and output a high level signal when the first digital signal is lower than the second digital signal.

In example embodiments, the first converter may include an integrator configured to convert the sensing driving current to a sensing driving voltage and to convert the target driving current to a target driving voltage, and an analog-digital converter configured to convert the sensing driving voltage to the first digital signal and to convert the target driving voltage to the second digital signal.

In example embodiments, the second converter may include a digital-analog converter configured to convert the output signal of the comparator to an analog signal and an amplifier configured to amplify the analog signal to the over driving voltage and provide the over driving voltage to the data line.

In example embodiments, the display panel may include a display area and a non-display area, and the compensating data generator may calculate the over driving data of the pixels in the display area.

In example embodiments, the display panel includes a display area and a non-display area, and the compensating data generator calculates the over driving data of dummy pixels in the non-display area.

According to an aspect of example embodiments, a method for generating a compensating data of a display device may include a step of displaying a sensing image that has a first grayscale in a (N−1)th frame and a second grayscale in a Nth frame and a (N+M)th frame on a display panel, where the N is an integer greater than or equal to 2, and the M is an integer greater than or equal to 1, a step of sensing a sensing driving current of pixels included in the display panel in the Nth frame of the sensing image, a step of sensing a target driving current of pixels included in the display panel in (N+M)th frame of the sensing image, a step of comparing the sensing driving current to the target driving current, a step of providing an over driving voltage to the pixels in the Nth frame when the sensing driving current is lower than the target driving current, and a step of calculating an over driving data based on the providing number of the over driving voltage when the sensing driving current is higher than or equal to the target driving current.

In example embodiments, a method for generating a compensating data of a display device may further include a step of changing the first grayscale and the second grayscale and a step of generating an over driving lookup table based on the over driving data.

In example embodiments, a grayscale value of the first grayscale may be lower than a grayscale value of the second grayscale.

In example embodiments, the over driving voltage may have a voltage level corresponding to 1 grayscale.

In example embodiments, a method for generating a compensating data of a display device may further include a step of performing a feedback loop that provide the over driving voltage to data lines included in the display panel until the sensing driving current is the same with the target driving current.

Therefore, a display device and a method for generating compensating data may improve display quality of the display device by sensing the driving current of a pixel, determining an over driving data of a first frame using a feedback loop, and generating an over driving lookup table based on the over driving data when luminance of the display panel is changed. Further, the optimized over driving lookup table may be generated regardless of a deviation of a display panel because the over driving lookup table is generated by the display device. Further, a manufacturing time for generating the over driving lookup table in a manufacturing process may be reduced because the over driving lookup table is generated after shipment of the display device.

BRIEF DESCRIPTION OF THE DRAWINGS

Illustrative, non-limiting example embodiments will be more clearly understood from the following detailed description taken in conjunction with the accompanying drawings.

FIGS. 3A through 3C are graphs illustrating a correlation of luminance and a driving current for describing the display device of FIG. 1.

FIG. 5 is a table illustrating an example of an over driving lookup table generated in the compensating data generator of FIG. 4.

DETAILED DESCRIPTION

Hereinafter, aspects of some example embodiments of the present inventive concept will be explained in more detail with reference to the accompanying drawings.

Figure 1:
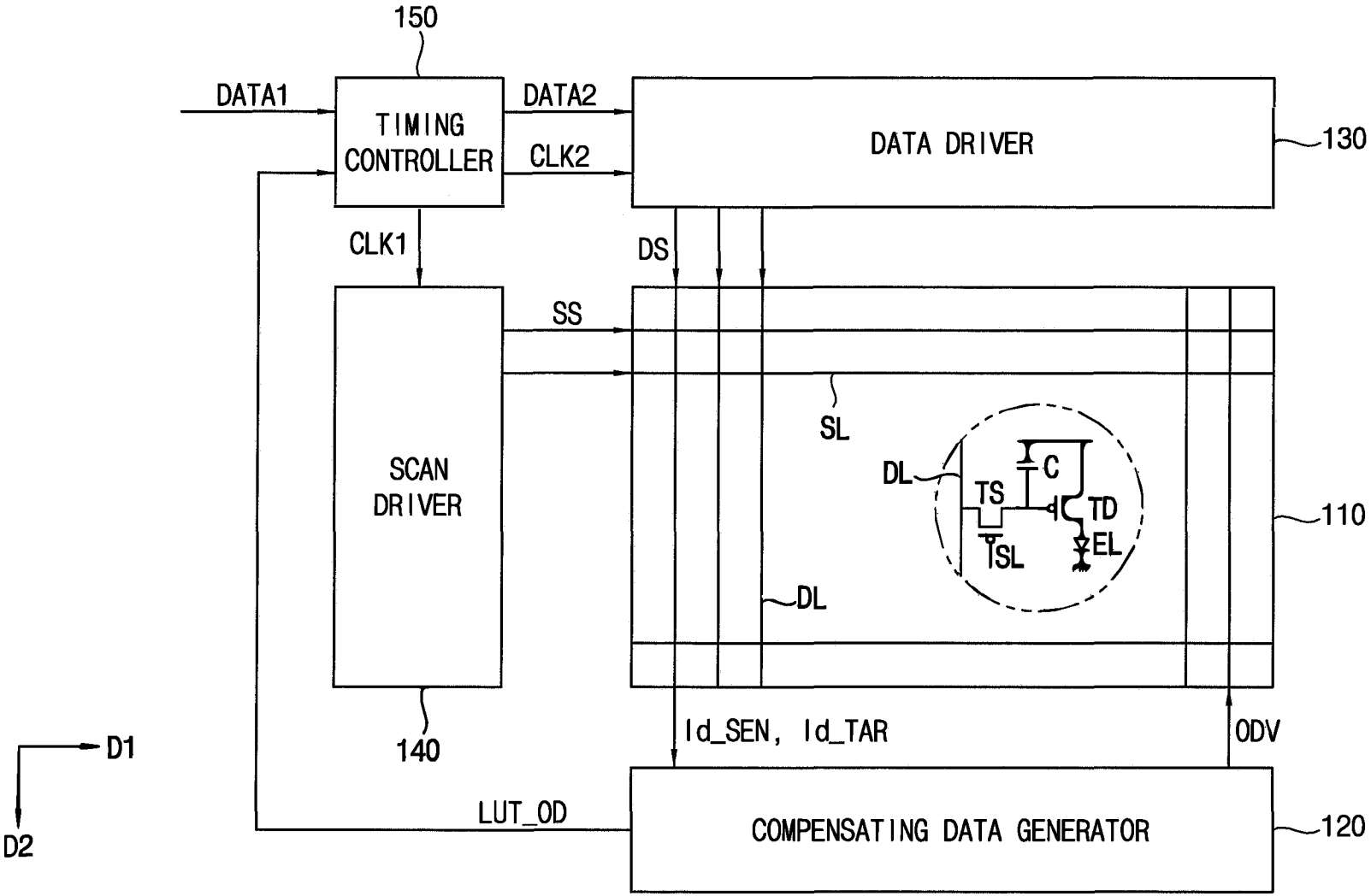
FIG. 1 is a block diagram illustrating a display device according to some example embodiments.
Figure 2:
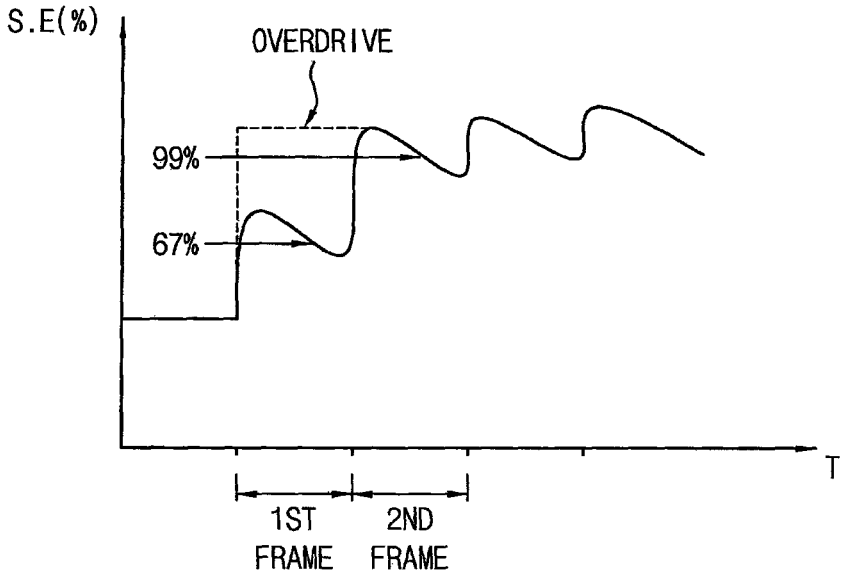
FIG. 2 is a graph illustrating luminance property of the display device according to a related-art technique.
Figure 3B:
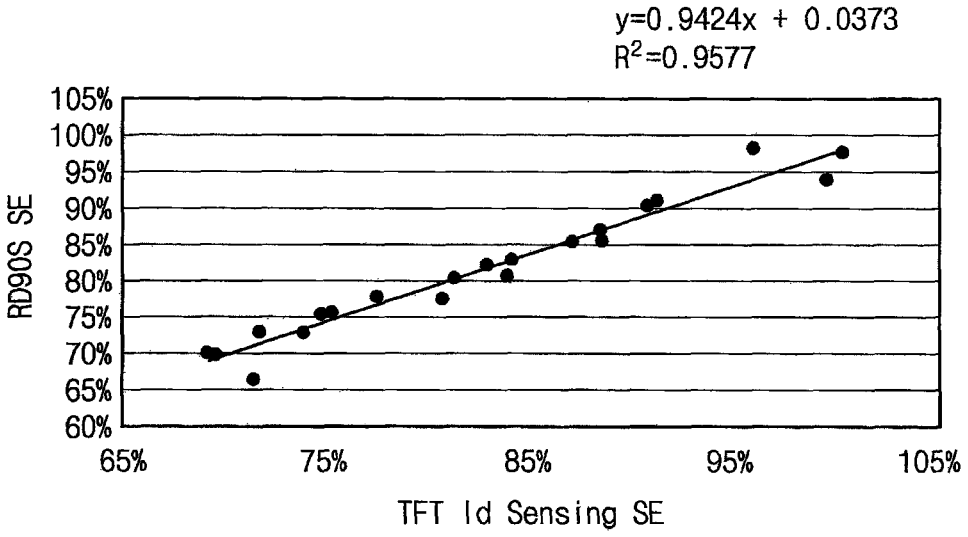
Figure 3C:
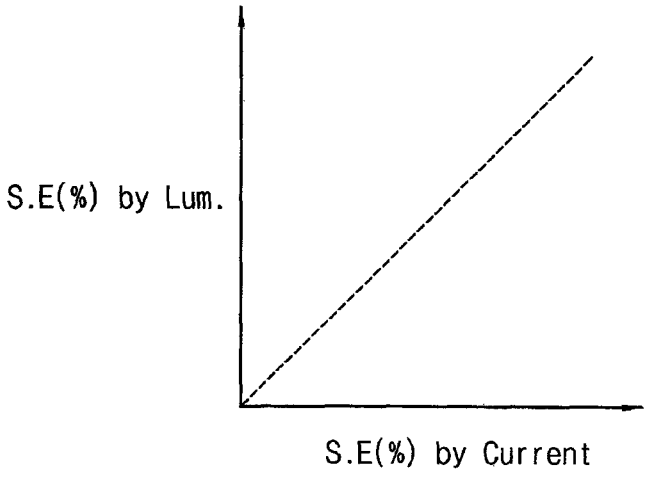

FIG. 1 is a block diagram illustrating a display device according to some example embodiments, FIG. 2 is a graph illustrating luminance property of the display device according to a conventional technique, and FIGS. 3A through 3C are graphs illustrating a correlation of luminance and a driving current for describing the display device of FIG. 1.

Referring to FIG. 1, a display device 100 may include a display panel 110, a compensating data generator 120, a data driver 130, a scan driver 140, and a timing controller 150.

The display panel 110 may include a plurality of data lines DL, a plurality of scan lines SL, and a plurality of pixels PX. The scan lines SL may extend in a first direction D1 and be arranged in a second direction D2 substantially perpendicular to the first direction D1. the data lines DL may extend in the second direction D2 and be arranged in the first direction D1. The first direction D1 may be parallel with a long side of the display panel 110, and the second direction D2 may be parallel with a short side of the display panel 110. Each of the pixels PX may be arranged in an intersection region of the data line DL and the gate line GL. Each of the pixels PX may include a driving transistor TD electrically coupled to the scan line SL and the data line, a switching transistor TS, a storage capacitor C, and an organic light emitting element EL. Thus, the display panel 110 may be an organic light emitting display panel, and the display device 100 may be an organic light emitting display device.

The compensating data generator 120 may generate an over driving lookup table LUT_OD of over driving of the pixel PX. The compensating data generator 120 may be coupled to each of the pixels PX in the display panel 110. In some example embodiments, the display panel 110 may include a display area and a non-display area, and the compensating data generator 120 may be coupled to the pixels PX arranged in the display area of the display panel 110. In other example embodiments, the display panel 110 may include the display area and the non-display area, and the compensating data generator 120 may be coupled to dummy pixels arranged in the non-display area of the display panel 110.

Referring to FIG. 2, luminance of a first frame may decrease when the luminance of an image displayed on the display panel 110 is changed because a time for charging a data voltage to the storage capacitor C of the pixel PX is short. For example, when the image displayed on the display panel 110 is changed from a first grayscale to a second grayscale, the image may not have the luminance corresponding to the second grayscale in the first frame because the time for charging the data voltage to the storage capacitor C of the pixel is not enough. A step efficiency (S.E) of the first frame of the image having the second grayscale may be lower than a step efficiency of the second frame of the image having the second grayscale as described in FIG. 2. Here, the step efficiency represents a ratio (or percentage) of luminance corresponding to each of the grayscale to luminance output from the display panel 110.

To overcome this problem, an over driving method that increases an amount of the data voltage charged to the storage capacitor C of the pixel PX by providing an over driving data higher than the driving data corresponding to the grayscale in the first frame may be used. The over driving data generated based on an image data of a previous frame and an image data of a present frame may be stored in the display device 100 as a lookup table (LUT). Generally, the over driving lookup table LUT_OD may be generated by measuring the luminance of the image displayed on the display panel 110 using a luminance measuring device in a manufacturing process of the display device 100 and calculating the over driving data that compensates a luminance decrease in the first frame when the luminance is changed.

In this case, a deviation of the display panel 110 may not be considered and a time for manufacturing the display device 100 may increase. To overcome this problem, the display deice 100 according to an example embodiments may measure a driving current of the pixel after shipment of the display device 100, determine the over driving data that allows the driving current of the first frame to be the same with the driving current of the second frame as change the data voltage of the first frame, and generating the over driving lookup table LUT_OD. Hereinafter, the compensating data generator 120 that generates the over driving lookup table LUT_OD will be described in more detail.

The compensating data generator 120 may sense a sensing driving current Id_SEN of the pixel PX in a Nth frame and a target driving current Id_TAR of the pixel in a (N+M)th frame, calculate the over driving data that allows the sensing driving current Id_SEN to be the same with the target driving current Id_TAR as changing the data voltage of the Nth frame, and generate the over driving lookup table LUT_OD based on the over driving data when a sensing image that has a first grayscale in a (N−1)th frame and a second grayscale in the Nth frame and the (N+M)th frame is displayed on the display panel, where the N is an integer greater than or equal to 2, and the M is an integer greater than or equal to 1.

The compensating data generator 120 may be coupled to the data line DL of the pixel PX arranged on the display panel 110. The compensating data generator 120 may sense a driving current flowing through the driving transistor included to the pixel PX through the data line DL and generate the over driving data based on the driving current.

Chart 1 and Chart 2 in FIG. 3A represent the step efficiency when the luminance of the image is changed. Chart 1 represents the step efficiency by measuring the luminance and Chart 2 represents the step efficiency by measuring the driving current. Referring to FIGS. 3B and 3C, the step efficiency by measuring the luminance and the step efficiency by measuring the driving current are correlated (correlation coefficient R>0.96). Thus, the compensating data generator 120 according to an example embodiments may generate the over driving data based on the driving current of the pixel PX.

The compensating data generator 120 may sense the sensing driving current Id_SEN of the pixel PX in the Nth frame and the target driving current Id_TAR when the sensing image having the first grayscale in (N−1)th frame and the second grayscale in the Nth frame and the (N+M)th frame is displayed on the display panel 110. Here, a grayscale value of the first grayscale may be lower than a grayscale value of the second grayscale. The driving current of the pixel PX in the Nth frame may be lower than the driving current of the pixel PX in the (N+M)th frame because the data voltage is not charged enough. Here, the compensating data generator 120 may store the driving current in the Nth frame as the sensing driving current Id_SEN and the driving current in the (N+M)th frame as the target driving current Id_TAR.

The compensating data generator 120 may determine the over driving data that allows the sensing driving current Id_SEN to be the same with the target driving current Id_TAR as changing the data voltage of the Nth frame. For example, the compensating data generator 120 may provide an over driving voltage ODV to the data line in the Nth frame and repeatedly sense the sensing driving current Id_SEN and the target driving current Id_TAR until the sensing driving current Id_SEN is higher than or equal to the target driving current Id-TAR. The compensating data generator 120 may perform this feedback loop. The over driving voltage ODV may have a voltage level corresponding to a predetermined reference grayscale.

For example, when the reference grayscale is 1 grayscale and the voltage level corresponding to the 1 grayscale is 2V, the over driving voltage ODV may be 2V. Alternatively, when the reference grayscale is 2 grayscale and the voltage level corresponding to the 1 grayscale is 2V, the over driving voltage ODV may be 4V. The over driving voltage ODV may have a various voltage level according to a property and a deviation of the display device 100. The compensating data generator 120 may provide the over driving voltage ODV to the data line DL coupled to the pixel PX in the Nth frame when the sensing driving current Id_SEN is lower than the target driving current Id_TAR. Thus, the sensing driving current Id_SEN in the Nth frame may increase. The compensating data generator 120 may provide the over driving voltage ODV to the data line DL until the sensing driving current Id_SEN is the same with the target driving current Id_TAR. The compensating data generator 120 may store the providing number of the over driving voltage ODV and calculate the over driving data based on the providing number of the over driving voltage ODV when the sensing driving current Id_SEN is higher than or equal to the target driving current Id_TAR. The over driving data may be calculated by adding a multiplying value of the reference grayscale by the providing number to the second grayscale.

For example, when the sensing image has 64 grayscale in the Nth frame and the reference grayscale is 1 grayscale, the providing number of the over driving voltage ODV is 5, the over driving data may have 69 grayscale (that is, ODV=64+(1×5)). For example, when the sensing image has 64 grayscale in the Nth frame and the reference grayscale is 2 grayscale, and the providing number of the over driving voltage is 5, the over driving data may have 74 grayscale (that is, ODV=64+(2×5)). The compensating data generator 120 may calculate the plurality of over driving data as changing the grayscale values of the first grayscale and the second grayscale and generate the over driving lookup table LUT_OD based on the over driving data.

The data driver 130 may generate the data signal DS corresponding to a second image data DATA2 in response to the second clock signal CLK2 provided from the timing controller 150 and output the data signal DS to the data line DL.

The scan driver 140 may generate the scan signal SS in response to the first clock signal CLK1 provided from the timing controller 150 and output the scan signal SS to the scan line SL.

The timing controller 150 may receive the first image data DATA1 from the external device. The timing controller 150 may receive the over driving lookup table LUT_OD from the compensating data generator 120. The timing controller 150 may convert the first image data DATA1 to the second image data DATA2 by performing an over driving and provide the second image data DATA2 to the data driver 130. In some example embodiments, the compensating data generator 120 may be coupled to the timing controller 150. In other example embodiments, the compensating data generator 120 may be arranged in the timing controller 150.

The display device 100 according to some example embodiments may generate the over driving lookup table LUT_OD when the display device 100 turn on or turn off (that is, power on or power off).

As described above, the display device 100 may sense the sensing driving current Id_SEN in the Nth frame and the target driving current Id_TAR in the (N+M)th frame, compare the sensing driving current Id_SEN to the target driving current Id_TAR, and calculate the over driving data that allows the sensing driving current Id_SEN to be the same with the target driving current Id_TAR by changing the data voltage of the Nth frame when the sensing image having the first grayscale in the (N−1)th frame and the second grayscale in the Nth frame and the (N+M)th frame is displayed on the display panel 110. Thus, the display device 100 may generate the over driving lookup table LUT_OD without an additional measuring device. Further, the deviation of the display panel 110 may be considered by generating the over driving lookup table LUT_OD based on the driving current of each of the display device 100.

Figure 4:
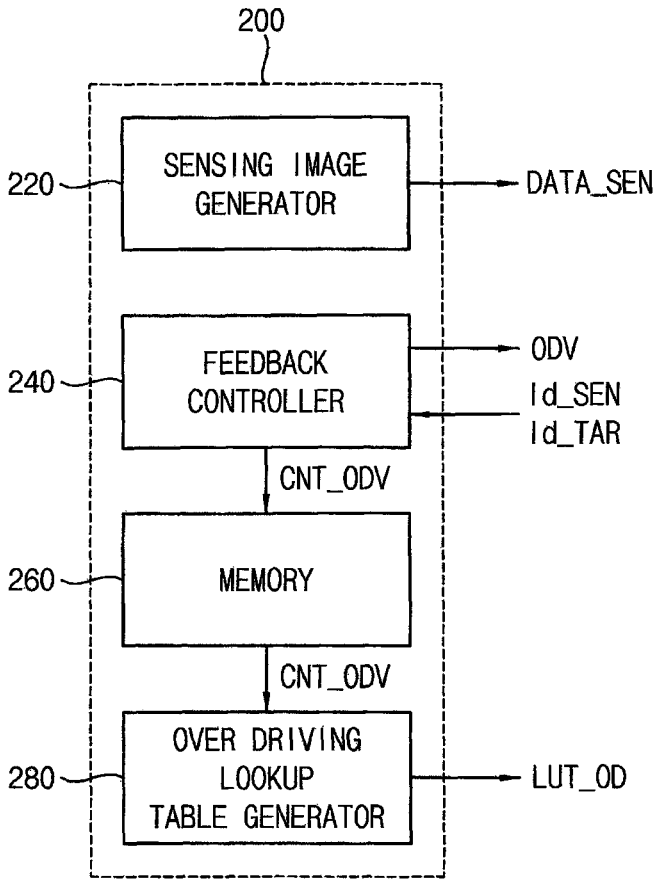
FIG. 4 is a block diagram illustrating a compensating data generator included in the display device of FIG. 1.

FIG. 4 is a block diagram illustrating a compensating data generator included in the display device of FIG. 1 and FIG. 5 is a table illustrating an example of an over driving lookup table generated in the compensating data generator of FIG. 4.

Referring to FIG. 4, the compensating data generator 200 may include a sensing image generator 220, a feedback controller 240, a memory 260, and an over driving lookup table generator 280. Here, the compensating data generator 200 may correspond to the compensating data generator 120 of FIG. 1.

The sensing image generator 220 may generate sensing image data DATA_SEN corresponding to the sensing image. The sensing image generator 220 may generate the sensing image data DATA_SEN having the first grayscale in the (N−1)th frame and the second grayscale in the Nth frame and the (N+M)th frame in order to calculate the over driving data ODD when the first grayscale is changed to the second grayscale. The sensing image data DATA_SEN may be provided to the data driver of the display device. The data driver may provide the data signal corresponding to the sensing image data DATA_SET to the display panel through the data line.

The feedback controller 240 may sense the sensing driving current Id_SEN and the target driving current Id_TAR. The feedback controller 240 may sense the sensing driving current Id_SEN and the target driving current TAR_SEN through the data line of the pixel when the sensing image is displayed on the display panel. The feedback controller 240 may provide the over driving voltage to the data line in the Nth frame when the sensing driving current Id_SEN is lower than the target driving current Id_TAR. The over driving voltage ODV may have a voltage level corresponding to the predetermined grayscale. For example, when the reference grayscale is 1 grayscale, the over driving voltage ODV may have the voltage level corresponding to the 1 grayscale. When the reference grayscale is 2 grayscale, the over driving voltage ODV may have the voltage level corresponding to the 1 grayscale. The feedback controller 240 may provide the over driving voltage ODV to the data line coupled to the pixel until the sensing driving current Id_SEN is higher than or equal to the target driving current Id_TAR. The feedback controller 240 may count the providing number CNT_ODV of the over driving voltage ODV when the sensing driving current Id_SEN is higher than or equal to the target driving current Id_TAR and provide the providing number CNT_ODV of the over driving voltage ODV to the memory 260.

The memory 260 may store the providing number CNT_ODV of the over driving voltage ODV provided from the feedback controller 240. Alternatively, the memory 260 may receive a counting signal as the over driving voltage ODV is provided to the data line and store the providing number CNT_ODV of the over driving voltage ODV based on the number of the counting signal.

The over driving lookup table generator 280 may calculate the over driving data ODD based on the providing number CNT_ODV of the over driving voltage ODV. The over driving data ODD may be calculated by adding the multiply value of the reference grayscale by the providing number CNT_ODV to the grayscale of the sensing image in the Nth frame (that is, the second grayscale).

$$ODD = GVn + (RGV \times CNT_ODV) \quad \text{<Equation 1>}$$

Where the ODD is the over driving data, the GVn is the grayscale vale of the sensing image in the Nth frame and CNT_ODV is the proving number of the over driving voltage ODV. For example, in the case that the second grayscale in the Nth frame is 64 grayscale, the reference grayscale is 1 grayscale, and the providing number CNT_ODV of the over driving voltage ODV is 5, the over driving data ODD may by 69 grayscale. The over driving lookup table generator may store the plurality of over driving data generated based on the sensing driving current Id_SEN and the target driving current Id_TAR measured by changing the first grayscale and the second grayscale. The over driving lookup table generator 280 may generate the over driving lookup table LUT_OD based on the over driving data ODD. For example, the over driving lookup table generator 280 may store over driving data ODD1 through ODD36 by changing the first grayscale and the second grayscale, and may generate the over driving lookup table LUT_OD based on the over driving data ODD1 through ODD 36. The over driving lookup table generator 280 may provide the over driving lookup table LUT_OD to the timing controller.

Figure 6:
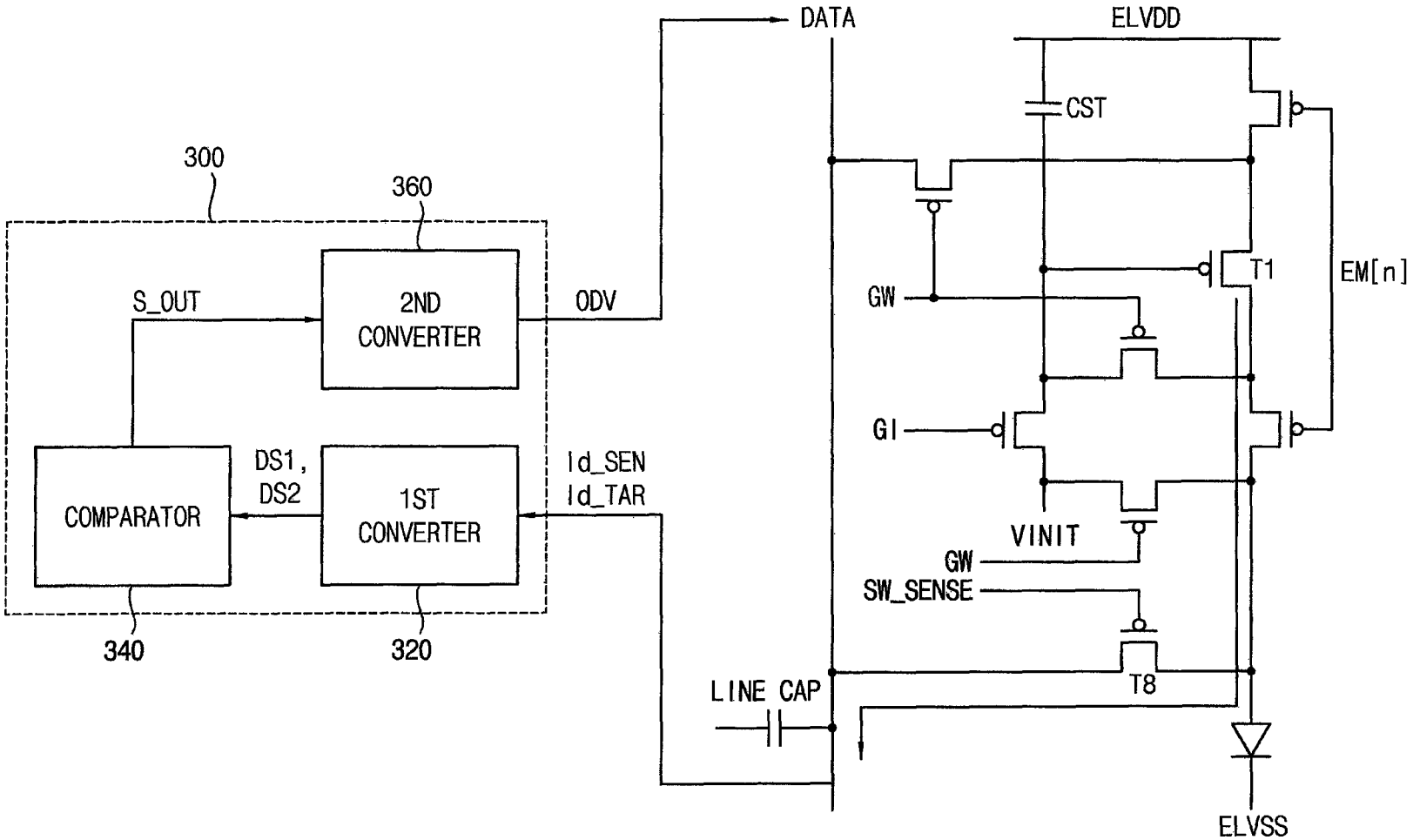
FIG. 6 is a block diagram illustrating a feedback controller included in the compensating data generator of FIG. 4.
Figure 7:
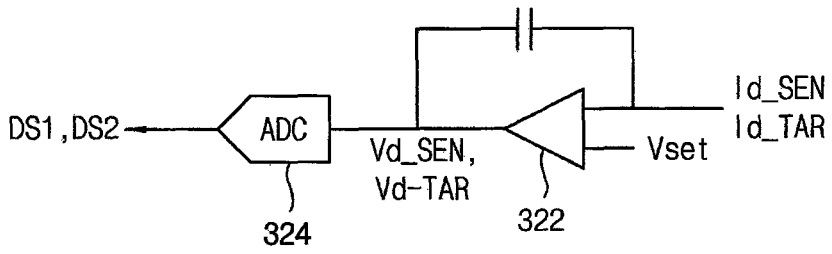
FIG. 7 is a circuit diagram illustrating an example of a first converter included in the feedback controller of FIG. 6.
Figure 8:
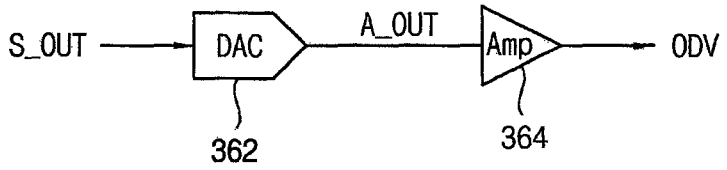
FIG. 8 is a circuit diagram illustrating an example of a second converter included in the feedback controller of FIG. 6.

FIG. 6 is a block diagram illustrating a feedback controller included in the compensating data generator of FIG. 4, FIG. 7 is a circuit diagram illustrating an example of a first converter included in the feedback controller of FIG. 6, and FIG. 8 is a circuit diagram illustrating an example of a second converter included in the feedback controller of FIG. 6.

Referring to FIG. 6, the feedback controller 300 may include a first converter 320, a comparator 340, and a second converter 360. The feedback controller 300 of FIG. 6 may correspond to the feedback controller 240 of FIG. 4. The feedback controller 300 may be coupled to the data line arranged in the display panel. The feedback controller 300 may generate the driving current of the driving transistor. The feedback controller 300 may provide the over driving voltage ODV to the data line.

The first converter 320 may convert the sensing driving current Id_SEN to a first digital signal DS1 and convert the target driving current Id_TAR to the second digital signal DS2. The first converter 320 may sense the sensing driving current Id_SEN flowing through the driving transistor through the data line and convert the sensing driving current Id_SEN to the first digital signal DS1 in the Nth frame. Further, the first converter 320 may sense the target driving current Id_TAR flowing through the driving transistor through the data line and convert the target driving current Id_TAR to the second digital signal DS2 in the (N+M)th frame.

Referring to FIG. 7, the first converter 320 may include an integrator 322 and an analog-digital converter (ADC) 324. The integrator 322 may integrate the driving current flowing through the driving transistor and output a driving voltage corresponding to the driving current. The integrator 322 may output the sensing driving voltage Vd_SEN corresponding to the sensing driving current Id_SEN by integrating the sensing driving current Id_SEN and output the target driving voltage Vd_TAR corresponding to the target driving current Id_TAR by integrating the target driving current Id_TAR. The analog-digital converter 324 may respectively convert the sensing driving voltage Vd_SEN and the target driving voltage Vd_TAR having analog values to the first digital signal DS1 and the second digital signal DS2.

The comparator 340 may compare the first digital signal DS1 and the second digital signal DS2 and output an output signal S_OUT. For example, the comparator 340 may output the low level signal when the first digital signal DS1 corresponding to the sensing driving current Id_SEN is higher than or equal to the second digital signal DS2 corresponding to the target driving current Id_TAR and output the high level signal when the first digital signal DS1 corresponding to the sensing driving current Id_SEN is smaller than the second digital signal DS2. For example, the low level signal may be a digital signal 0, and the high level signal may be a digital signal 1.

The second converter 360 may convert the output signal S_OUT from the comparator 340 to the analog signal and output the analog signal as the over driving voltage ODV. Referring to FIG. 8, the second converter 360 may include a digital-analog converter (DAC) 362 and an amplifier 364. The digital-analog converter 362 may convert the output signal S_OUT from the comparator 340 to an analog output signal A_OUT. The amplifier 364 may amplify the analog output signal A_OUT to the over driving voltage ODV having the voltage level corresponding to a predetermined grayscale value. For example, the amplifier 364 may amplify the analog output signal A_OUT provided from the digital-analog converter 362 to the over driving voltage ODV having the voltage level corresponding to 1 grayscale when the predetermined grayscale value is the 1 grayscale.

The over driving voltage ODV may be provided to the data line in the Nth frame of the sensing image. Here, the sensing driving current Id_SEN sensed through the data line may increase.

As described above, the feedback controller 300 may perform the feedback loop by sensing the sensing driving current Id_SEN and the target driving current Id_TAR, providing the over driving voltage ODV to the data line according to a comparing result of the sensing driving current Id_SEN and the target driving current Id_TAR, and repeatedly sensing the sensing driving current Id_SEN and the target driving current Id_TAR.

Figure 9:
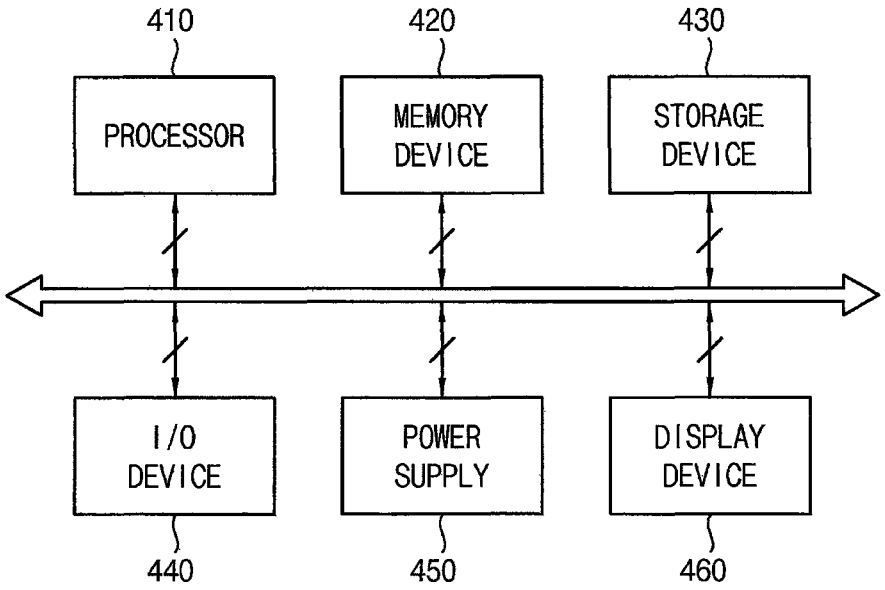
FIG. 9 is a black diagram illustrating an electronic device that includes the display device of FIG. 1.
Figure 10:
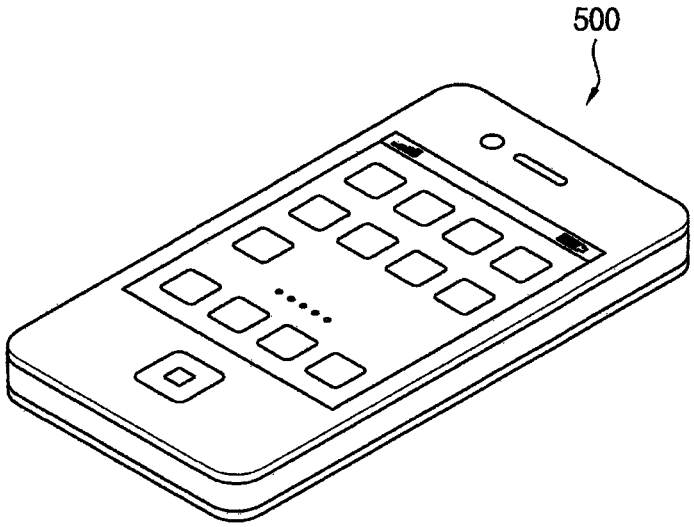
FIG. 10 is a diagram illustrating an example embodiment in which the electronic device of FIG. 9 is implemented as a smart phone.

FIG. 9 is a black diagram illustrating an electronic device that includes the display device of FIG. 1 and FIG. 10 is a diagram illustrating an example embodiment in which the electronic device of FIG. 9 is implemented as a smart phone.

Referring to FIGS. 9 and 10, an electronic device 400 may include a processor 410, a memory device 420, a storage device 430, an input/output (I/O) device 440, a power device 450, and a display device 460. Here, the display device 460 may correspond to the display device 100 of FIG. 1. In addition, the electronic device 400 may further include a plurality of ports for communicating a video card, a sound card, a memory card, a universal serial bus (USB) device, other electronic device, etc. Although it is illustrated in FIG. 10 that the electronic device 400 is implemented as a smart phone 500, a kind of the electronic device 400 is not limited thereto.

The processor 410 may perform various computing functions. The processor 410 may be a microprocessor, a central processing unit (CPU), etc. The processor 410 may be coupled to other components via an address bus, a control bus, a data bus, etc. Further, the processor 410 may be coupled to an extended bus such as surrounded component interconnect (PCI) bus. The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 430 may be a solid stage drive (SSD) device, a hard disk drive (HDD) device, a CD-ROM device, etc.

The I/O device 440 may be an input device such as a keyboard, a keypad, a touchpad, a touch-screen, a mouse, etc, and an output device such as a printer, a speaker, etc. In some example embodiments, the display device 460 may be included in the I/O device 440. The power device 450 may provide a power for operations of the electronic device 400. The display device 460 may communicate with other components via the buses or other communication links. As described above, the display device 460 may include a display panel and a compensating data generator. The display panel may include a plurality of data lines, a plurality of scan lines, and a plurality of pixels. The data driving generator may sense a sensing driving current of the pixel in a Nth frame and a target driving current of the pixel in a (N+M)th frame, calculate an over driving data that allow the sensing driving current to be the same with the target driving current by changing a data voltage of the Nth frame and generate an over driving lookup table based on the over driving data when a sensing image having a first grayscale in a (N−1)th frame and having a second grayscale in the Nth frame and the (N+M)th frame.

Figure 11:
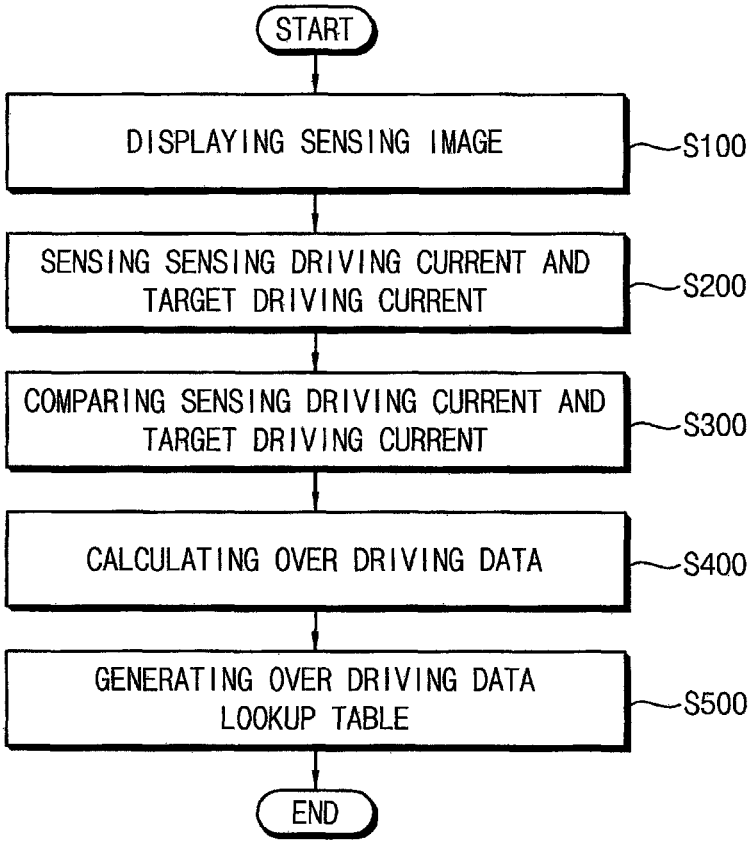
FIG. 11 is a flow chart illustrating a method for generating a compensating data of a display device according to some example embodiments.
Figure 12:
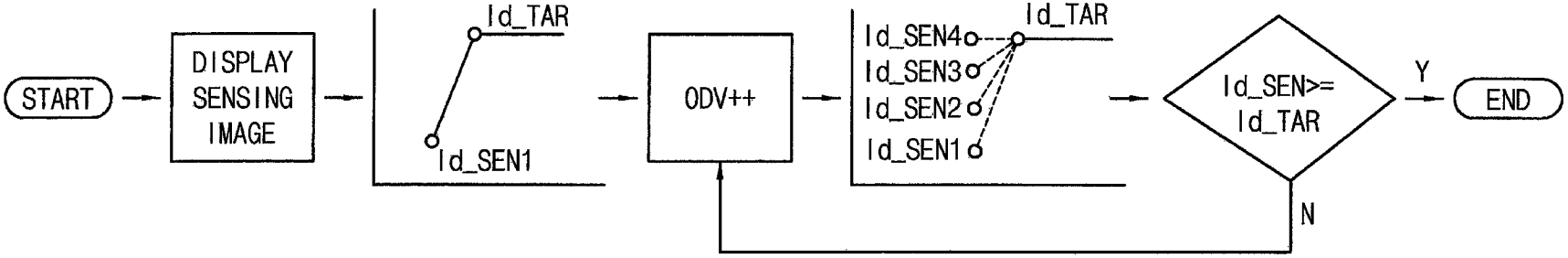
FIG. 12 is a diagram illustrating for describing the method for generating a compensating data of FIG. 8.

FIG. 11 is a flow chart illustrating a method for generating a compensating data of a display device according to example embodiments and FIG. 12 is a diagram illustrating for describing the method for generating a compensating data of FIG. 8.

Referring to FIG. 11, a method for generating a compensating data of a display device may include a step of displaying a sensing image on a display panel S100, a step of sensing a sensing driving current and a target driving current S200, a step of comparing the sensing driving current and the target driving current S300, a step of calculating an over driving data S400, and a step of generating the over driving lookup table S500.

The method of generating the compensating data of the display device may display the sensing image on the display panel S100. The sensing image may have a first grayscale in a (N−1)th frame and a second grayscale in a Nth frame and a (N+M)th frame.

The method of generating the compensating data of the display device may sense the sensing driving current and the target driving current when the sensing image is displayed on the display panel S200. The method of generating the compensating data of the display device may sense the sensing driving current of pixel included in the display panel in the Nth frame of the sensing image and the target driving current of the pixel included in the display panel in the (N+M)th frame.

The method of generating the compensating data of the display device may compare the sensing driving current and the target driving current S300. An over driving voltage may be provided to a data line of the pixel in the Nth frame when the sensing driving current is smaller than the target driving current. The over driving voltage may have a voltage level corresponding to a predetermined reference grayscale.

The method of generating the compensating data of the display device may calculate the over driving data based on the providing number of the over driving voltage when the sensing driving current is higher than or equal to the target driving current S400. The over driving data may be calculated by adding a multiplying value of the reference grayscale by the providing number of the over driving voltage to the second grayscale.

The method of generating the compensating data of the display device may generate the over driving lookup table based on the over driving data S500. The method of generating the compensating data of the display device may calculate the plurality of over driving data by changing the first grayscale and the second grayscale and generate the over driving lookup table based on the plurality of over driving data.

Referring to FIG. 12, the method of generating the compensating data of the display device may perform the feedback loop. The sensing image having the first grayscale in the (N−1)th frame and the second grayscale in the Nth frame and the (N+M)th frame may be displayed on the display panel. The sensing driving current Id_SEN1 may be sensed in the Nth frame. The target driving current Id_TAR may be sensed in the (N+M)th frame. The over driving voltage ODV may be provided to the data line when the sensing driving current Id_SEN1 is lower than the target driving current Id_TAR. The over driving voltage may have the voltage lever corresponding to the predetermined reference grayscale. A voltage level of the sensing driving current Id_SEN1 may increase (that is, the sensing driving current Id_SEN2) when the over driving voltage ODV is provided to the data line. The feedback loop may be performed by providing the over driving voltage ODV and sensing the sensing driving current Id_SEN of the Nth frame until the sensing driving current Id_SEN is higher than or equal to the target driving current Id_TAR. The feedback loop may be finished when the sensing driving current Id_SEN is higher than or equal to the target driving current Id_TAR.

As described above, the display device 460 may improve display quality by sensing the sensing driving current in the Nth frame and the target driving current in the (N+M)th frame when the sensing image having the first grayscale in the (N−1)th frame and the second grayscale in the Nth frame and the (N+M)th frame, comparing the sensing driving current to the target driving current, and calculating the over driving data that allows the sensing driving current to be the same with the target driving current. Further, the display device may generate the optimized over driving lookup table regardless of the deviation of the display panel.

Aspects of example embodiments of the present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of data lines including a data line, a plurality of gate lines, and a plurality of pixels including a pixel electrically coupled to the data line and including a driving transistor; and a compensating data generator configured to generate sensing image data corresponding to a sensing image having a first grayscale in an (N−1)th frame and having a second grayscale in an Nth frame and an (N+M)th frame, to provide the sensing image data to the display panel to display the sensing image, to sense from the data line a sensing driving current flowing through the driving transistor of the pixel in the Nth frame and a target driving current flowing through the driving transistor of the pixel in the (N+M)th frame when the sensing image is displayed, and to calculate an over driving data that allows the sensing driving current to be higher than or equal to the target driving current by changing a data voltage of the Nth frame, where N is an integer greater than or equal to 2, and M is an integer greater than or equal to 1, wherein the compensating data generator includes a feedback controller configured to perform a feedback loop to increase and provide an over driving voltage to the data line of the display panel until the sensing driving current is higher than or equal to the target driving current.

2. The display device of claim 1, wherein the compensating data generator is configured to generate the plurality of over driving data by changing a grayscale value of the first grayscale and a grayscale value of the second grayscale, and to generate an over driving lookup table (LUT) based on the plurality of over driving data.

3. The display device of claim 1, wherein a grayscale value of the first grayscale is lower than a grayscale value of the second grayscale.

4. The display device of claim 1, wherein the compensating data generator includes:

a sensing image generator configured to generate the sensing image data corresponding to the sensing image;

the feedback controller, the feedback controller being further configured to sense the sensing driving current and the target driving current, to provide the over driving voltage to the data line of the display panel in the Nth frame when the sensing driving current is lower than the target driving current, and to provide a providing number of the over driving voltage to a memory when the sensing driving current is higher than or equal to the target driving current;

the memory configured to store the providing number of the over driving voltage provided from the feedback controller; and an over driving lookup table generator configured to calculate the over driving data based on the providing number of the over driving voltage and to generate an over driving lookup table based on the over driving data.

5. The display device of claim 4, wherein the over driving voltage has a voltage level corresponding to a predetermined reference grayscale.

6. The display device of claim 5, wherein the over driving data is calculated by adding a multiplying value of the reference grayscale by the providing number to the second grayscale.

7. The display device of claim 4, wherein the feedback controller includes:

a first converter configured to convert the sensing driving current to a first digital signal and to convert the target driving current to a second digital signal;

a comparator configured to compare the first digital signal to the second digital signal and to output a comparing result as an output signal; and a second converter configured to convert the output signal to an analog signal and to output the analog signal as the over driving voltage.

8. The display device of claim 7, wherein the comparator is configured to output a low level signal when the first digital signal is higher than or equal to the second digital signal, and to output a high level signal when the first digital signal is lower than the second digital signal.

9. The display device of claim 7, wherein the first converter includes:

an integrator configured to convert the sensing driving current to a sensing driving voltage and to convert the target driving current to a target driving voltage; and an analog-digital converter configured to convert the sensing driving voltage to the first digital signal and to convert the target driving voltage to the second digital signal.

10. The display device of claim 7, wherein the second converter includes:

a digital-analog converter configured to convert the output signal of the comparator to an analog signal; and an amplifier configured to amplify the analog signal to the over driving voltage and provide the over driving voltage to the data line.

11. The display device of claim 1, wherein the display panel includes a display area and a non-display area, and wherein the compensating data generator is configured to calculate the over driving data of the pixels in the display area.

12. The display device of claim 1, wherein the display panel includes a display area and a non-display area, and wherein the compensating data generator is configured to calculate the over driving data of dummy pixels in the non-display area.

13. A method for generating a compensating data of a display device, the method comprising:

displaying a sensing image that has a first grayscale in an (N−1)th frame and a second grayscale in an Nth frame and an (N+M)th frame on a display panel, where N is an integer greater than or equal to 2, and the M is an integer greater than or equal to 1;

sensing, from a data line included in the display panel, a sensing driving current flowing through a driving transistor of a pixel included in the display panel in the Nth frame of the sensing image;

sensing, from the data line, a target driving current flowing through the driving transistor of the pixel included in the display panel in the (N+M)th frame of the sensing image;

comparing the sensing driving current to the target driving current;

providing an over driving voltage to the pixels in the Nth frame when the sensing driving current is lower than the target driving current;

calculating an over driving data based on a providing number of the over driving voltage when the sensing driving current is higher than or equal to the target driving current; and performing a feedback loop that increases and provides the over driving voltage to the data line until the sensing driving current is higher than or equal to the target driving current.

14. The method for claim 13, further comprising:

changing the first grayscale and the second grayscale; and generating an over driving lookup table based on the over driving data.

15. The method for claim 13, wherein a grayscale value of the first grayscale is lower than a grayscale value of the second grayscale.

16. The method for claim 13, wherein the over driving voltage has a voltage level corresponding to 1 grayscale.

* * * * *